US006419355B1

(12) United States Patent
Bermel et al.

(10) Patent No.: US 6,419,355 B1
(45) Date of Patent: Jul. 16, 2002

(54) INK JET PRINTING METHOD

(75) Inventors: Alexandra D. Bermel, Pittsford; Lori J. Shaw-Klein, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/770,807

(22) Filed: Jan. 26, 2001

(51) Int. Cl.[7] ..... B41J 2/01
(52) U.S. Cl. ..... 347/105; 428/195
(58) Field of Search ..... 347/105, 100, 347/101; 428/195

(56) References Cited

U.S. PATENT DOCUMENTS 5,747,146 A * 5/1998 Kashiwazaki et al. ..... 347/105
5,789,070 A * 8/1998 Shaw-Klein et al. ..... 347/105
6,299,303 B1 * 10/2001 Wexler ..... 347/105

FOREIGN PATENT DOCUMENTS

EP 0908324 A1 * 4/1999 ..... B41M/5/00
EP 1002660 A1 5/2000

* cited by examiner

*Primary Examiner*—John Barlow
*Assistant Examiner*—Manish S. Shah
(74) *Attorney, Agent, or Firm*—Harold E. Cole

(57) ABSTRACT

An ink jet printing method, including the steps of:

A) providing an ink jet printer that is responsive to digital data signals;

B) loading the printer with an ink jet recording element including a support having thereon in order:

I) a porous base layer including particles having a primary particle size of from about 7 to about 40 nm in diameter which may be aggregated up to about 300 nm and which are dispersed in a binder; and II) a porous image-receiving layer including:

(a) particles having a primary particle size of from about 7 to about 40 nm in diameter which may be aggregated up to about 300 nm; and (b) water insoluble, cationic, polymeric particles comprising at least about 20 mole percent of a cationic mordant moiety;

the thickness of layer I) being between about 35 and about 50 $\mu$m and the thickness of layer II) being between about 2 and about 6 $\mu$m;

C) loading the printer with an ink jet ink composition; and

D) printing on the image-receiving layer using the ink jet ink composition in response to the digital data signals.

20 Claims, No Drawings

INK JET PRINTING METHOD

CROSS REFERENCE TO RELATED APPLICATIONS

Reference is made to commonly assigned, co-pending U.S. Patent Applications:

Ser. No. 09/770,814 by Bermel et al., filed of even date herewith entitled "Ink Jet Recording Element";

Ser. No. 09/771,191 by Bermel et al., filed of even date herewith entitled "Ink Jet Recording Element";

Ser. No. 09/770,429 by Bermel et al., filed of even date herewith entitled "Ink Jet Recording Element";

Ser. No. 09/770,782 by Bermel et al., filed of even date herewith entitled "Ink Jet Recording Element";

Ser. No. 09/771,187 by Bermel et al., filed of even date herewith entitled "Ink Jet Printing Method";

Ser. No. 09/770,433 by Bermel et al., filed of even date herewith entitled "Ink Jet Printing Method";

Ser. No. 09/770,728 by Bermel et al., filed of even date herewith entitled "Ink Jet Printing Method";

Ser. No. 09/770,128 by Lawrence et al., filed of even date herewith entitled "Ink Jet Printing Method";

Ser. No. 09/770,127 by Lawrence et al., filed of even date herewith entitled "Ink Jet Printing Method";

Ser. No. 09/770,781 by Lawrence et al., filed of even date herewith entitled "Ink Jet Printing Method";

Ser. No. 09/771,251 by Lawrence et al., filed of even date herewith entitled "Ink Jet Printing Method";

Ser. No. 09/770,122 by Lawrence et al., filed of even date herewith entitled "Ink Jet Printing Method";

Ser. No. 09/712,097 by Lawrence et al., filed of even date herewith entitled "Ink Jet Printing Method"; and Ser. No. 09/770,431 by Lawrence et al., filed of even date herewith entitled "Ink Jet Printing Method".

FIELD OF THE INVENTION

The present invention relates to a method for using a porous ink jet recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An inkjet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by cast coating, in which a particulate-containing coating is applied to a support and is dried in contact with a polished smooth surface.

When a porous recording element is manufactured, it is difficult to co-optimize the image-receiving layer surface appearance and ink drying times. Good image-receiving layer surface appearance is obtained when it is virtually crack-free and has high gloss. A crack-free surface appearance and high gloss can be obtained merely by adding more binder to the image-receiving layer. However, adding more binder increases dry time since the binder fills the pores in the image-receiving layer. Therefore, it is difficult to obtain an image-receiving layer which has a crack-free, glossy surface yet is fast-drying.

In addition, when a porous recording element is printed with dye-based inks, the dye molecules penetrate the coating layers. However, there is a problem with such porous recording elements in that the optical densities of images printed thereon are lower than one would like. The lower optical densities are believed to be due to optical scatter which occurs when the dye molecules penetrate too far into the porous layer. Thus, it is very difficult to obtain an image-receiving layer which has a crack-free, glossy surface yet is fast-drying, and in addition has high image density when printed.

EP 1,002,660 relates to a porous ink jet recording element comprising fine particles, hydrophilic binder and a water-soluble, cationic polymer. However, there is a problem with this element in that the density of an image printed on such an element using a water-soluble cationic polymer is lower than one would like.

It is an object of this invention to provide a method for using a porous ink jet recording element that has a good overall appearance with high gloss without cracking, has an excellent dry time and has high image densities when printed.

SUMMARY OF THE INVENTION

These and other objects are achieved in accordance with the invention which comprises an ink jet printing method, comprising the steps of:

A) providing an ink jet printer that is responsive to digital data signals;

B) loading the printer with an ink jet recording element comprising a support having thereon in order:

I) a porous base layer comprising particles having a primary particle size of from about 7 to about 40 nm in diameter which may be aggregated up to about 300 nm and which are dispersed in a binder; and II) a porous image-receiving layer comprising:

(a) particles having a primary particle size of from about 7 to about 40 nm in diameter which may be aggregated up to about 300 nm; and (b) water insoluble, cationic, polymeric particles comprising at least about 20 mole percent of a cationic mordant moiety;

the thickness of layer I) being between about 35 and about 50 $\mu$m and the thickness of layer II) being between about 2 and about 6 $\mu$m;

C) loading the printer with an ink jet ink composition; and

D) printing on the image-receiving layer using the ink jet ink composition in response to the digital data signals.

By use of the process of the invention, a porous ink jet recording element is obtained that has a good overall appearance with high gloss without cracking, has an excellent dry time and has high image densities when printed.

DETAILED DESCRIPTION OF THE INVENTION

As noted above, the recording element employed in the invention contains a base layer containing certain particles, next to the support, the function of which is to absorb the solvent from the ink. These particles may be the same or different from the (a) particles in the image-receiving layer, described hereinafter. This base layer may also contain a binder, such as those binders described hereinafter for the image-receiving layer.

Examples of (a) particles useful in the invention include alumina, boehmite, clay, calcium carbonate, titanium dioxide, calcined clay, aluminosilicates, silica, barium sulfate, or polymeric beads. The particles may be porous or nonporous. In a-preferred embodiment of the invention, the particles are metallic oxides, preferably fumed. While many types of inorganic and organic particles are manufactured by various methods and commercially available for an image-receiving layer, porosity of the ink-receiving layer is necessary in order to obtain very fast ink drying. The pores formed between the particles must be sufficiently large and interconnected so that the printing ink passes quickly through the layer and away from the outer surface to give the impression of fast drying. At the same time, the particles must be arranged in such a way so that the pores formed between them are sufficiently small that they do not scatter visible light.

The (a) particles may be in the form of primary particles, or in the form of secondary aggregated particles. The aggregates are comprised of smaller primary particles about 7 to about 40 nm in diameter, and being aggregated up to about 300 nm in diameter. The pores in a dried coating of such aggregates fall within the range necessary to ensure low optical scatter yet sufficient ink solvent uptake.

Preferred examples of fumed metallic oxides which may be used in the invention as the (a) particles include alumina, silica and cationic silica. Fumed metallic oxides are available in dry form or as dispersions of the aggregates mentioned above.

The (b) water insoluble, cationic, polymeric particles comprising at least about 20 mole percent of a cationic mordant moiety useful in the invention can be in the form of a latex, water dispersible polymer, beads, or core/shell particles wherein the core is organic or inorganic and the shell in either case is a cationic polymer. Such particles can be products of addition or condensation polymerization, or a combination of both. They can be linear, branched, hyperbranched, grafted, random, blocked, or can have other polymer microstructures well known to those in the art. They also can be partially crosslinked. Examples of core/shell particles useful in the invention are disclosed and claimed in U.S. patent application Ser. No. 09/722,097 of Lawrence et al., Ink Jet Printing Method, filed of even date herewith, the disclosure of which is hereby incorporated by reference. Examples of water dispersible particles useful in the invention are disclosed and claimed in U.S. patent application Ser. No. 09/770,128 of Lawrence et al., Ink Jet Printing Method, filed of even date herewith, and U.S. patent application Ser. No. 09/770,127 of Lawrence et al., Ink Jet Printing Method, filed of even date herewith, Docket 81817HEC, the disclosures of which are hereby incorporated by reference. Examples of latex particles useful in the invention are disclosed in Ser. No. 09/770,814 by Bermel et al., filed of even date herewith entitled "Ink Jet Recording Element", the disclosure of which is hereby incorporated by reference. In a preferred embodiment, the water insoluble, cationic, polymeric particles comprise at least about 50 mole percent of a cationic mordant moiety.

The (b) water insoluble, cationic, polymeric particles useful in the invention can be derived from nonionic, anionic, or cationic monomers. In a preferred embodiment, combinations of nonionic and cationic monomers are employed. In general, the amount of cationic monomer employed in the combination is at least about 20 mole percent.

The nonionic, anionic, or cationic monomers employed can include neutral, anionic or cationic derivatives of addition polymerizable monomers such as styrenes, alpha-alkylstyrenes, acrylate esters derived from alcohols or phenols, methacrylate esters, vinylimidazoles, vinylpyridines, vinylpyrrolidinones, acrylamides, methacrylamides, vinyl esters derived from straight chain and branched acids (e.g., vinyl acetate), vinyl ethers (e.g., vinyl methyl ether), vinyl nitrites, vinyl ketones, halogen-containing monomers such as vinyl chloride, and olefins, such as butadiene.

The nonionic, anionic, or cationic monomers employed can also include neutral, anionic or cationic derivatives of condensation polymerizable monomers such as those used to prepare polyesters, polyethers, polycarbonates, polyureas and polyurethanes.

The (b) water insoluble, cationic, polymeric particles employed in this invention can be prepared using conventional polymerization techniques including, but not limited to bulk, solution, emulsion, or suspension polymerization.

The amount of (b) water insoluble, cationic, polymeric particles used should be high enough so that the images printed on the recording element will have a sufficiently high density, but low enough so that the interconnected pore structure formed by the aggregates is not filled. In a preferred embodiment of the invention, the weight ratio of (b) water insoluble, cationic, polymeric particles to (a) particles is from about 1:2 to about 1:10, preferably about 1:5.

Examples of (b) water insoluble, cationic, polymeric particles which may be used in the invention include those described in U.S. Pat. No. 3,958,995, the disclosure of which is hereby incorporated by reference. Specific examples of these polymers include:

Polymer A. Copolymer of (vinylbenzyl) trimethylammonium chloride and divinylbenzene (87:13 molar ratio)

Polymer B. Terpolymer of styrene, (vinylbenzyl) dimethylbenzylamine and divinylbenzene (49.5:49.5:1.0 molar ratio)

Polymer C. Terpolymer of butyl acrylate, 2-aminoethylmethacrylate hydrochloride and hydroxyethylmethacrylate (50:20:30 molar ratio)

Polymer D. Copolymer of styrene, dimethylacrylamide, vinylbenzylimidazole and 1-vinylbenzyl-3-hydroxyethylimidazolium chloride (40:30:10:20 molar ratio)

Polymer E. Copolymer of styrene, 4-vinylpyridine and N-(2-hydroxyethyl)-4-vinylpyridinium chloride (30:38:32 molar ratio)

Polymer F. Copolymer of styrene, (vinylbenzyl) dimethyloctylammonium chloride), isobutoxymethyl acrylamide and divinylbenzene (40:20:34:6 molar ratio)

In a preferred embodiment of the invention, the image-receiving layer also contains a polymeric binder in an amount insufficient to alter the porosity of the porous receiving layer. In another preferred embodiment, the polymeric binder is a hydrophilic polymer such as poly(vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. In still another preferred embodiment of the invention, the hydrophilic polymer is poly(vinyl alcohol), hydroxypropyl cellulose, hydroxypropyl methyl cellulose, gelatin, or a poly(alkylene oxide). In yet still another preferred embodiment, the hydrophilic binder is poly(vinyl alcohol). The polymeric binder should be chosen so that it is compatible with the aforementioned particles.

The amount of binder used should be sufficient to impart cohesive strength to the ink jet recording element, but should also be minimized so that the interconnected pore structure formed by the aggregates is not filled in by the binder. In a preferred embodiment of the invention, the weight ratio of the binder to the total amount of particles is from about 1:20 to about 1:5.

Since the image-receiving layer is a porous layer comprising particles, the void volume must be sufficient to absorb all of the printing ink. For example, if a porous layer has 60 volume % open pores, in order to instantly absorb 32 $cc/m^2$ of ink, it must have a physical thickness of at least about 54 $\mu$m.

As noted above, the thickness of layer I) is between about 35 and about 50 $\mu$m to absorb all the solvent from the ink so that the recording element will be quick drying. The thickness of layer II) is between about 2 and about 6 $\mu$m so that the image density of an image printed thereon will be optimized.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, polyethylene-coated paper is employed.

The support used in the invention may have a thickness of from about 50 to about 500 $\mu$m, preferably from about 75 to 300 $\mu$m. Antioxidants, antistatic agents, plasticizers and other known additives may be incorporated into the support, if desired.

In order to improve the adhesion of the ink-receiving layer to the support, the surface of the support may be subjected to a corona-discharge treatment prior to applying the image-receiving layer.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30 per cent active coating aid based on the total solution weight. These coating aids can be nonionic, anionic, cationic or amphoteric. Specific examples are described in MCCUTCHEON's Volume 1: Emulsifiers and Detergents, 1995, North American Edition.

The coating composition can be coated either from water or organic solvents, however water is preferred. The total solids content should be selected to yield a useful coating thickness in the most economical way, and for particulate coating formulations, solids contents from 10–40% are typical.

Ink jet inks used to image the recording elements used in the present invention are well-known in the art. The ink compositions used in ink jet printing typically are liquid compositions comprising a solvent or carrier liquid, a colorant such as a dye or pigment, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference. In a preferred embodiment of the invention, the colorant is a water-soluble anionic dye. Examples of such dyes are found, for example, in Ser. No. 09/770,128 by Lawrence et al., (Docket 81815) filed of even date herewith entitled "Ink Jet Printing Method", the disclosure of which is hereby incorporated by reference.

The following example is provided to illustrate the invention.

EXAMPLE

Element 1 of the Invention

A coating solution for the image-receiving layer was prepared by combining fumed alumina (Cab-O-Sperse® PG003, Cabot Corp.), poly(vinyl alcohol) (Gohsenol® GH-23A, Nippon Gohsei Co.), and mordant polymeric particles of a copolymer of (vinylbenzyl) trimethylammonium chloride and divinylbenzene (87:13 molar ratio), in a ratio of 85:3:12 to give an aqueous coating formulation of 10% solids by weight. Surfactants Zonyl® FSN (E. I. du Pont de Nemours and Co.) and Olin® 10G (Dixie Chemical Co.) were added in small amounts as coating aids.

A coating solution for the base layer was prepared by combining fumed alumina (Cab-O-Sperse® PG003, Cabot Corp.), poly(vinyl alcohol) (Gohsenol® GH-23A, Nippon Gohsei Co., Ltd.) and 2,3-dihydroxy-1,4-dioxane (Clariant Corp.) in a ratio of 88:10:2 to give an aqueous coating formulation of 30% solids by weight.

The layers were simultaneously bead-coated at 40° C. on polyethylene-coated paper base which had been previously subjected to corona discharge treatment. The image-receiving layer was coated on top of the base layer. The coating was then dried at 60° C. by forced air to yield a two-layer recording element in which the thicknesses of the topmost and bottom layers were 1 μm and 39 μm, respectively.

Elements 2–5 of the Invention

Elements 2–5 were prepared the same as Element 1 except that the thicknesses of the image-receiving layer and the base layer were varied as described in Table 1.

Comparative Elements 1–9

Comparative Elements 1–9 were prepared the same as Element 1 except that the thicknesses of the image-receiving layer and the base layer were varied as described in Table 1.

Comparative Elements 10–12

These elements were prepared the same as Element 1 except that the water-insoluble, cationic, polymeric particles of a copolymer of (vinylbenzyl)trimethylammonium chloride and divinylbenzene (87:13 molar ratio) were replaced with the following comparative cationic polymers which are water-soluble:

C-1 Polyethyleneimine, available as Lupasol® PEI from BASF Corp.

C-2 Poly(diallyldimethylammonium chloride), available as Merquat® 100 from Calgon Corp.

C-3 Poly[N-[3-(dimethylamino)propyl]-N'-[3-ethyleneoxyethylene dimethylammonium)propyl]urea dichloride], available as Mirapol® WT from Rhone-Poulenc Co.

Coating Quality

The dried coatings were visually evaluated for cracking defects.

Gloss

The dried coatings were measured for 60° specular glossiness using a Gardener® Gloss Meter. A gloss measurement of at least about 60% is desirable.

Dry Time

Test images of cyan, magenta, yellow, red, green, blue and black bars, each 1.1 cm by 13.5 cm, were printed using an Epson Stylus® Photo 870 using inks with catalogue number T008201. Immediately after ejection from the printer, a piece of bond paper was placed over the printed image and rolled with a smooth, heavy weight. Then the bond paper was separated from the printed image. Ink transferred to the bond paper if the recording element was not dry. The length of the bar imaged on the bond paper was measured. The length of the bar imaged on the bond paper was measured and is proportional to the dry time. Dry times corresponding to a length of about 4 cm or less are acceptable.

TABLE 1

| Recording Element | Base Layer (μm) | Image-Receiving Layer (μm) | 60° Gloss (%) | Coating Quality | Proportional Dry Time (cm) |
|---|---|---|---|---|---|
| C-1 | 38 | 0 | 47 | no cracking | 5 |
| 1 | 39 | 1 | 68 | no cracking | 0 |
| 2 | 38 | 2 | 68 | no cracking | 2 |
| 3 | 38 | 3 | 67 | no cracking | 3 |
| 4 | 37 | 3 | 69 | no cracking | 1.5 |
| 5 | 36 | 4 | 72 | no cracking | 0 |
| C-2 | 35 | 5 | 68 | no cracking | 8 |
| C-3 | 34 | 6 | 73 | Cracking | 6 |
| C-4 | 33 | 7 | 73 | Cracking | 5 |
| C-5 | 32 | 8 | 72 | Cracking | 5 |
| C-6 | 31 | 9 | 73 | Cracking | 5 |
| C-7 | 30 | 10 | 70 | Cracking | 5 |
| C-8 | 29 | 11 | 72 | Cracking | 7 |
| C-9 | 28 | 12 | 72 | Severe cracking | 7 |

The data in Table 1 show that Elements 1–5 employed in the invention are better than the control elements for a combination of gloss, coating quality and dry time.

Density Testing

Test images of cyan, magenta, yellow, red, green and blue patches at 100% ink laydown were printed on Elements 1–5 of the invention and Comparative Elements 10–12 using an Epson Stylus® Photo 870 using inks with catalogue number T008201. After drying for 24 hours at ambient temperature and humidity, the Status A densities were measured using an X-Rite® 820 densitometer as follows (for each of the red, green and blue densities, the two component color densities were measured and averaged):

TABLE 2

| | Status A D-max Density | | |
|---|---|---|---|
| Element | Red | Green | Blue |
| 1 | 1.28 | 1.50 | 1.60 |
| 2 | 1.39 | 1.62 | 1.74 |
| 3 | 1.45 | 1.70 | 1.84 |
| 4 | 1.46 | 1.70 | 1.84 |
| 5 | 1.51 | 1.80 | 1.88 |
| C-10 | 1.23 | 1.33 | 1.47 |
| C-11 | 1.06 | 1.23 | 1.33 |
| C-12 | 1.12 | 1.24 | 1.38 |

The data in Table 2 show that Examples 1–5 employed in the invention had higher densities than the Comparative Elements C-10 to C-12.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet printing method, comprising the steps of:

A) providing an ink jet printer that is responsive to digital data signals;

B) loading said printer with an inkjet recording element comprising a support having thereon in order:

I) a porous base layer comprising particles having a primary particle size of from about 7 to about 40 nm in diameter which may be aggregated up to about 300 nm and which are dispersed in a binder; and II) a porous image-receiving layer comprising:

(a) particles having a primary particle size of from about 7 to about 40 nm in diameter which may be aggregated up to about 300 nm; and (b) water insoluble, cationic, polymeric particles comprising at least about 20 mole percent of a cationic mordant moiety;

the thickness of layer I) being between about 35 and about 50 μm and the thickness of layer II) being between about 2 and about 6 μm;

C) loading said printer with an ink jet ink composition; and

D) printing on said image-receiving layer using said ink jet ink composition in response to said digital data signals.

2. The method of claim 1 wherein the weight ratio of (b) water insoluble, cationic, polymeric particles to (a) particles is from about 1:2 to about 1:10.

3. The method of claim 1 wherein said porous image-receiving layer also contains a polymeric binder in an amount insufficient to significantly alter the porosity of said porous image-receiving layer.

4. The method of claim 3 wherein the weight ratio of said binder to the total amount of particles is from about 1:20 to about 1:5.

5. The method of claim 3 wherein said polymeric binder is a hydrophilic polymer.

6. The method of claim 5 wherein said hydrophilic polymer is poly(vinyl alcohol), hydroxypropyl cellulose, hydroxypropyl methyl cellulose, gelatin, or a poly(alkylene oxide).

7. The method of claim 3 wherein said polymeric binder is poly(vinyl alcohol).

8. The method of claim 1 wherein said particles in I) and II) (a) are both metallic oxides.

9. The method of claim 1 wherein said particles in I) and II) (a) are both porous.

10. The method of claim 8 wherein said particles are fumed.

11. The method of claim 10 wherein said particles are fumed alumina.

12. The method of claim 1 wherein said water insoluble, cationic, polymeric particles are in the form of a latex.

13. The method of claim 12 wherein said latex is a copolymer of (vinylbenzyl)trimethylammonium chloride and divinylbenzene in a 87:13 molar ratio.

14. The method of claim 12 wherein said latex is a terpolymer of styrene, (vinylbenzyl)dimethylbenzylamine and divinylbenzene in a 49.5:49.5:1.0 molar ratio.

15. The method of claim 1 wherein said water insoluble, cationic, polymeric particles are in the form of a water dispersible polymer.

16. The method of claim 3 wherein said porous base layer and/or said image-receiving layer also contains a crosslinker capable of crosslinking said binder.

17. The method of claim 16 wherein said crosslinker is an aldehyde, an acetal or a ketal.

18. The method of claim 17 wherein said crosslinker is 2,3-dihydroxy-1,4-dioxane.

19. The method of claim 1 wherein said water insoluble, cationic, polymeric particles comprise at least about 50 mole percent of a cationic mordant moiety.

20. The method of claim 1 wherein said ink jet ink composition contains a water-soluble anionic dye.

* * * * *